US005167050A

United States Patent [19]

Korsen

[11] Patent Number: 5,167,050

[45] Date of Patent: Dec. 1, 1992

[54] BUNDLING DEVICE

[76] Inventor: David W. Korsen, P.O. Box 4656, Boise, Id. 83711

[21] Appl. No.: 813,683

[22] Filed: Dec. 27, 1991

[51] Int. Cl.[5] ..... B65D 63/00

[52] U.S. Cl. ..... 24/16 R; 24/306; 24/442

[58] Field of Search ..... 24/16 R, 16 PB, 17 AP, 24/30.5 P, 304, 306, 442; 248/205.2; 2/DIG. 6; 128/DIG. 15

[56] References Cited

U.S. PATENT DOCUMENTS

| | | | |
|---|---|---|---|
| 3,022,557 | 2/1962 | Logan | 24/17 AP |
| 3,543,977 | 12/1970 | Lockridge | 128/DIG. 15 |
| 4,414,969 | 11/1983 | Heyman | 128/DIG. 15 |
| 4,862,563 | 9/1989 | Flynn | 24/442 |
| 4,878,274 | 11/1989 | Patricy | 24/306 |
| 4,888,830 | 12/1989 | Putnam | 24/DIG. 6 |
| 4,893,381 | 1/1990 | Frankel | 24/442 |
| 4,939,818 | 7/1990 | Hahn | 24/442 |
| 4,963,410 | 10/1990 | Bryant | 24/16 R |
| 5,048,158 | 9/1991 | Koerner | 24/16 R |
| 5,075,933 | 12/1991 | Kemper | 24/16 R |

*Primary Examiner*—Victor N. Sakran
*Attorney, Agent, or Firm*—Paul F. Horton

[57] ABSTRACT

A device for bundling objects such as cords, cables, wire, and hose comprising an elongated flexible strap having one side hook-loop material and having on the opposing side, for engagement therewith, complementary hook-loop material; having one one end of the strap a clasp for looping the strap therethrough to encircle an object for fastening the device thereto; having a rigid threading member on an opposing end of the strap for convenient threading of the strap through the clasp; and having, extending outwardly from a top side of the strap and in alignment therewith, a flexible tongue member having hook-loop material thereon of the same type as the adjacent surface of the strap enabling the strap to be divided into two sections for holding a portion of the cord, cable, or like, while holding a second portion in its bundled mode. The tongue engages the strap in a shearing position, as opposed to a peeling position, when the strap is suspended by the threading member to greatly increase the integrity of the device in its bundling capacity.

8 Claims, 1 Drawing Sheet

BUNDLING DEVICE

BACKGROUND OF THE INVENTION

1. Field of the Invention

This invention relates, in general, to bundling straps for cords, cables, hose, and the like, and, in particular to bundling straps utilizing hook-loop fasteners.

2. Description of the Prior Art

The advantages of utilizing hook-loop material, commonly marketed under the trademark VELCRO ®, for bundling straps has long been recognized because of the almost infinite degrees of adjustment of the strap, the convenience of use, and for many other reasons.

Recent development include the straps of Frankel, U.S. Pat. No. 4,893,381; Hahn, U.S. Pat. No. 4,939,818; and Bryant, U.S. Pat. No. 4,963,410. The strap of Frankel includes two tape segments joined together, each segment having one and only one side covered with a peel resistant face for forming two separate closures for bundling. The device of Hahn includes a single strap having opposing sides provided with hook-loop material; the end portions covered with a hook-loop material complementary with the center portion. Bryant utilizes a cinch ring affixed to a strap for encircling one end of a cord or other elongated member to be bundled.

SUMMARY OF THE INVENTION

The present invention is a bundling device which includes a strap provided on opposing sides with complementary hook-loop materials. The strap is provided with a tongue member covered at least on one side with hook-loop material complementary to the opposing side of the strap from which the tongue is affixed. The strap includes a clasp at one end for looping the strap about an object for attachment of the device to the object and includes a threading member on the opposing end of the strap for drawing the strap through the clasp. A more complete description of the invention may be found in the appended claims.

It is a primary object of the present invention to provide a bundling device which includes a strap having complementary hook-loop materials on opposing sides thereof for engagement to define a first bundling loop and which includes a tongue with hook-loop material complementary with the opposing side of the strap to which the tongue is attached to define a second bundling loop.

More particularly, it is an object of the present invention to provide a bundling device in which the strap and tongue lie parallel with one another in a single direction and in front to back engaging relationship to form a bundling loop with superior shear force.

It is also an object of the present invention to provide a bundling device which includes a clasp for attachment of the device to the end of a cord, cable, or the like, or to another object so as to prevent loss of the device.

Another object of the present invention is to provide a bundling device which includes a rigid threading member for convenient threading of the strap and tongue through a clasp.

More particularly, it is an object of the present invention to provide a bundling device which has a threading member which includes a suspension aperture or hook for hanging of the device, with bundled object, from a support pin.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
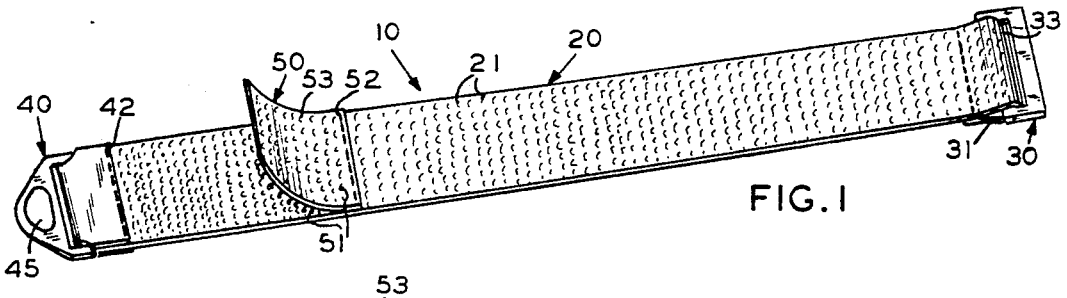
FIG. 1 is a perspective view of the bundling device of the present invention.
Figure 2:
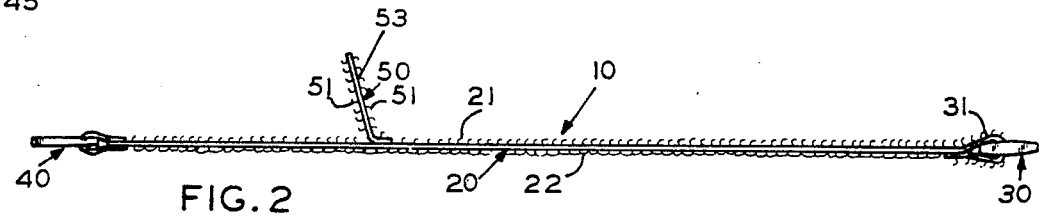
FIG. 2 is a cross sectional view of the device of FIG. 1.

Referring now to the drawings, and, more particularly, to FIGS. 1 and 2, an embodiment to be preferred of a bundling device 10, made according to the present invention is disclosed. Bundling device 10 includes, generally, an elongated flexible strap 20; a clasp 30; a substantially rigid threading member 40; and a flexible tongue 50.

Strap 20, in the embodiment shown, is constructed of fabric, approximately eighteen inches in length and two inches in width, having on opposing sides complementary, i.e., mating, hook and loop material, commonly marked under the trademark VELCRO ®. Length and width of material may be altered according to the type of object bundled. For example, for bundling water hose, lengths of up to three feet have been used. As shown in FIGS. 1 and 2, one side of the strap, arbitrarily called the top side, is provided with a multiplicity of hooks 21 and on the opposing or bottom side, with a multiplicity of loops 22. Hooks are engageable with loops to define a fastener which may be readily separated when one is pulled substantially perpendicular to the other, but which adhere with great shear force when pulled parallel to one another.

At a first end portion is affixed clasp 30, as by loop member 31, defined by the strap and sewed or otherwise affixed to the clasp. Clasp 30, which may be constructed of rigid thermoset plastic material, metal, or other suitable material, is of a modified "O" construction, having adjoining linear sides and end members to define an elongated opening 33 for connection of strap 20, as above described, and also for the threading through of strap 20 and tongue 50.

To facilitate the threading, a clasp threading member 40 may be provided. Member 40 is affixed to the second end of strap 20, also as by stitches 42. Member 40 is sufficiently rigid to prevent folding of the member and is also preferably constructed of plastic or metal. For suspension of bundling device 10, with cord, hose, or other object bundled, clasp threading member 40 is provided with a hook or aperture 45 for reception of a suspension member such as a pin or nail 3, shown in FIG. 5.

Figure 4:
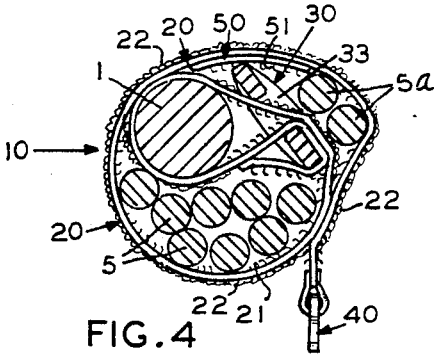
FIG. 4 is a cross sectional view of the device, shown in the bundling mode.

Projecting upwardly and outwardly from the top side of strap 20 and from what may be considered a center portion of the strap is tongue 50. Like the strap, the tongue is constructed of elongated flexible material, but is of a length such as not to extend to either end of the strap. The tongue may be unitary with the strap and joinder 52 may be by stitches or other suitable means. In the preferred embodiment, the tongue is of equal width to strap 20 and is only two inches in length, being affixed to the strap approximately six inches from the end of the strap to which clasp threading member 40 is attached, thus leaving about four inches of uninterrupted surface area of the top side of the strap adjacent member 40. Tongue 40 is of sufficient flexibility so as to lie flat against the top side of strap 20, as during the threading procedure. On at least one side 53 of tongue 50, and preferably both sides, are a multiplicity of hook-loop fasteners which are of the same type as the hook-loop fasteners on the top side of strap 20, i.e., hooks 51 in the drawings. While the hook and loop materials may be reversed on both the strap and tongue, taken as a unit, and still work properly, it is very desirable that the hooks and loops be, as shown in the figures, in that, when the strap is brought back upon itself to form a band, as shown in FIG. 4, the loop material will be on the exterior surface of the band and thereby prevent unwanted catching, as would be the case with hooks. Further, loops on the exterior surface provide a soft padded feeling to the user.

Figure 3:
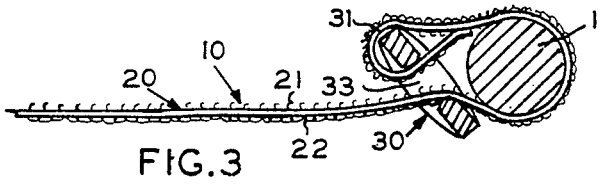
FIG. 3 is a view of one end of the device of FIG. 1, showing the strap threaded through an end clasp to form a loop about an object.

For attaching bundling device 10 to an object to which one may wish it permanently, or at least attached for some time, as for example, handle 1 of a vacuum cleaner, as shown in FIG. 3, strap 20 is simply threaded completely through clasp 30 to form a loop about the object. The same procedure may be followed for attaching device 10 to an electric cord, adjacent the plug-in, for example, where one wishes the device to be attached to the cord to prevent the bundling device 10 from being mislaid.

Referring to FIG. 4, the procedure for bundling elongated objects such as wire, hose, cable, cords, and the like, segments of which are represented by numerals 5 and 5*a*, may be appreciated. While FIG. 4 also shows bundling device 10 attached, as previously described, to a vacuum cleaner handle 1, or other object, this step in the procedure may obviously be omitted, where attachment is not desired. Should it be desired that most coiled segments 5 of an electric cord, for example, be held together, and possibly connected by device 10 to an object 1, and that a lesser number of segments 5*a* be free to be extended, i.e., unbundled, the cord 5 is first coiled upon itself a selected number of times and strap 20 is then simply strung through the coils and back upon itself around the coiled segments 5 to form a band about the cord with loops 22 of the strap being on the exterior surface of the band, as shown. Hooks 51 of tongue 50 are then caused to engage loops 22 of strap 20 by pressing the hooks and loops together to secure the band about the cord. The coiled position of the cord 5*a*, the only portion of the cord which one may wish to release, is then enclosed by the the remainder of strap 20, extending between the end of tongue 51 and threading member 40, as shown. To release coil segments 5*a*, one simply grasps threading member 40 and then pulls backward to pull the fastening elements apart. It is to be noted and appreciated that once the strap is peeled back to the joinder 52 of tongue and strap, that the shear force becomes much greater in that continued pulling of the strap results in the tongue being pulled substantially parallel to the strap portion to which it is attached by the hook-loop members. To detach the tongue 50 from strap 20 to loosen coil segments 5, the tongue must be grasped at its free terminal end and pulled away from the strap.

Figure 5:
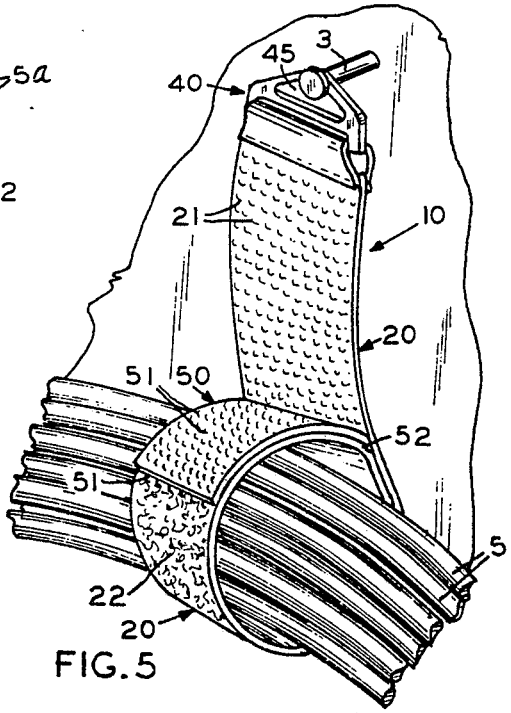
FIG. 5 is a partial perspective view of the device showing suspension of the device, with bundled cord, and showing resistance to peeling because of coaction of tongue and strap.

It is also to be noted and appreciated that the strong shear force, because of the angle of pull on strap 20 relative to tongue 50, enables the bundling device 10, with bundled objects 5, to be suspended, as shown in FIG. 5, and yet maintain its bundling integrity. The pull of gravity causes tongue 50 to be pulled substantially parallel in relationship to the portion of strap 20 to which it is attached by hook-loop fasteners 51 and 22, respectively, to prevent disengagement.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A bundling device for bundling objects, comprising:

an elongated flexible strap having a first end portion, a second end portion, and a center portion and said strap having a top side provided with hook-loop material and a bottom side provided with complementary hook-loop material;

a clasp provided at the terminal end of said first end portion for threading of said strap therethrough to define a loop for encircling an object to attach the object to the strap; and a flexible tongue member, having opposing surfaces, affixed to the top side of said strap, said tongue member having at least one surface of which is provided with hook-loop material of the same type as said top side of said strap and said tongue of a length insufficient to extend to either end of said strap to permit engagement between all portions of said strap extending beyond said tongue with the opposing side of said strap.

2. The device as described in claim 1, wherein said second end of said strap is provided with a clasp threading member for threading said strap through said clasp.

3. The device as described in claim 2, wherein said threading member is provided with an opening for receiving a suspension member for hanging the device, with object bundled, from said suspension member.

4. The device as described in claim 1, wherein said top side of strap is provided with a multiplicity of hook members; wherein said second side of said strap is provided with a multiplicity of loop members; and wherein said tongue member has at least one surface provided with a multiplicity of said hook members.

5. A bundling device for bundling objects, comprising:

an elongated flexible strap having a first end portion, a second end portion, and a center portion and said strap having a top side provided with hook-loop material and a bottom side provided with complementary hook-loop material;

a clasp provided at the terminal end of said first end portion for threading of said strap therethrough to define a loop for encircling an object to attach the object to the strap;

a clasp threading member provided at the terminal end of said second end portion, said clasp threading member provided with an opening for receiving a suspension member for hanging the device, with object bundled, from said suspension member; and a flexible tongue member affixed to the top side of said strap, said tongue member having opposing surfaces which are provided with hook-loop material of the same type as said top side of said strap for engaging the complementary hook-loop material of the bottom side of said strap, once looped, for causing the tongue to be pulled substantially parallel to the strap to prevent disengagement when said strap is suspended by said clasp threading member.

6. The device as described in claim 5, wherein said top side of said strap is provided with a multiplicity of hook members; wherein said second side of said strap is provided with a multiplicity of loop members; and wherein said tongue member has both surfaces provided with a multiplicity of said hook members.

7. A bundling device for bundling objects, comprising:

an elongated flexible strap having a first end portion, a second end portion, and a center portion and said strap having a top side provided with hook material and a bottom side provided with complementary loop material;

a clasp provided at the terminal end of said first end portion for threading of said strap therethrough to define a loop for encircling an object to attach the object to the strap;

a clasp threading member affixed to said second end portion of said strap for threading said strap through said clasp; and a flexible tongue member affixed to the top side of said strap, said tongue member having opposing surfaces which are provided with hook material.

8. The device as described in claim 7 wherein said clasp threading member is provided with means for engaging a suspension member.

* * * * *